US006840817B2

(12) United States Patent
Chen

(10) Patent No.: US 6,840,817 B2
(45) Date of Patent: Jan. 11, 2005

(54) EMI SUPPRESSION TECHNIQUE FOR RJ CONNECTORS WITH INTEGRATED MAGNETICS

(75) Inventor: John Chen, Danville, CA (US)

(73) Assignee: Bel Fuse, Pleasanton, CA (US)

( * ) Notice: Subject to any disclaimer, the term of this patent is extended or adjusted under 35 U.S.C. 154(b) by 0 days.

(21) Appl. No.: 10/328,836

(22) Filed: Dec. 23, 2002

(65) Prior Publication Data

US 2003/0129877 A1 Jul. 10, 2003

Related U.S. Application Data

(63) Continuation of application No. 09/934,748, filed on Aug. 22, 2001, now abandoned.
(60) Provisional application No. 60/227,113, filed on Aug. 22, 2000.

(51) Int. Cl.[7] ..... H01R 24/00
(52) U.S. Cl. ..... 439/676; 439/620
(58) Field of Search ..... 439/941, 607, 439/676, 620, 541.5, 76.1

(56) References Cited

U.S. PATENT DOCUMENTS 5,277,625 A * 1/1994 Iannella et al. ..... 439/620
5,331,505 A * 7/1994 Wilheim ..... 361/306.3
6,227,911 B1 * 5/2001 Boutros et al. ..... 439/620
6,302,741 B1 * 10/2001 Fasold et al. ..... 439/620

* cited by examiner

*Primary Examiner*—Ross Gushi
(74) *Attorney, Agent, or Firm*—Ostrolenk, Faber, Gerb & Soffen, LLP

(57) ABSTRACT

An RJ connector with integrated magnetics which incorporates a structure to eliminate aperture leakage. In one embodiment, the RJ connector includes a housing having a top portion and a bottom portion and structured and arranged to receive a plug. A plurality of contact fingers are provided in the housing for making contact with corresponding contacts in the plug. Placed on the bottom portion of the housing is a bottom shield. The bottom shield comprises an insulating material and electrically isolated sections of conductive material embedded within the insulating material. The conductive material and the insulating material form an electrostatic/electromagnetic shield on the bottom of the connector. Each section of conductive material is connected to one of the signal pins of the connector. By carefully controlling the area, shape, and/or thickness of the conducting and insulating materials within the bottom shield, and their relative positions to one another, a certain amount of electrical capacitance will be present between each of the signal pins and ground. This capacitance acts to shunt any high frequency electronic noise present on the signal lines and effectively prevents EMI from exiting the system enclosure.

13 Claims, 9 Drawing Sheets

EMI SUPPRESSION TECHNIQUE FOR RJ CONNECTORS WITH INTEGRATED MAGNETICS

CROSS REFERENCE TO RELATED APPLICATION

This application is a continuation of U.S. application Ser. No. 09/934,748 filed Aug. 22, 2001, now abandoned, entitled "EMI SUPPRESSION TECHNIQUE FOR RJ CONNECTORS WITH INTEGRATED MAGNETICS" which claims the benefit and priority of U.S. Provisional Application Ser. No. 60/227,113 filed Aug. 22, 2000 entitled "EMI SUPPRESSION TECHNIQUE FOR RJ-45 CONNECTORS WITH INTEGRATED MAGNETICS" the disclosure of which is incorporated by reference.

BACKGROUND OF THE INVENTION

The present invention relates to electromagnetic interference suppression devices for RJ connectors. In particular, the present invention relates to RJ connectors which suppress electromagnetic interference at the bottom portion of the connector.

Networking and telecommunications equipment commonly use RJ connectors as the interface between the data terminal equipment and the unshielded twisted pair cables which carry the high-speed data signals. The high-speed digital signals entering and/or leaving the system by means of these connectors and their associated cables are prone to having Electromagnetic Interference (EMI) problems at the interface of the RJ connectors and the cable.

The printed circuit board (PCB) layout and system design of the networking and telecommunications equipment is critical to the functional and EMI performance of that system. There are many different techniques used by PCB and systems designers to combat EMI. However, many of the tried-and-true EMI suppression techniques were developed for a standard configuration where the line interface magnetics are separated from the RJ connectors.

A typical line interface configuration that is used in Ethernet and other networking equipment is where the PCB layout has separate ground planes that are specifically partitioned to keep different types of signals localized in distinct functional blocks. With this typical line interface configuration, there are several important factors which prevent EMI from being coupled onto the data transmission cables. One factor is that the RJ connector is placed on a ground plane that is electrically separated from the rest of the PCB and connected to the system chassis. This effectively creates a barrier that isolates the RJ connector from the noisy digital signal currents present on the PCB. Additionally, the chassis ground plane shields the RJ connector from the electromagnetic fields present on the PCB and inside the system enclosure.

While effectively suppressing EMI noise, such line interface configurations, however, have many disadvantages. These systems often require a large amount of PCB area, additional spacing for safety and hi-pot requirements, localized noise filtering and bypass, an increased magnitude and number of parasitic circuit elements, and a non-optimum component placement and special PCB track routing techniques.

With the rapid advances in technology bringing forth electronic circuits and systems that are smaller, faster and more complex, PCBs are becoming more densely packed, with virtually every square millimeter of board space being utilized. Hence, the PCB area required for bulky connectors and other hardware is becoming more critical, and systems designers are looking for ways to reduce the area consumed by such hardware.

One breakthrough in connector technology is an RJ connector with integrated magnetics, such as the BelMag™ product line from Bel Fuse, Inc. Many of the disadvantages of standard line interface configurations are alleviated with the use of RJ connectors with integrated magnetics. By combining the line interface magnetics and the RJ connector into a single housing, a substantial reduction in the required PCB area is realized. Moreover, the integrated connector provides significant improvements in the overall systems performance.

Accordingly, these RJ connectors with integrated magnetics are being deployed in networking and telecommunications systems as a means to reduce size, lower manufacturing costs, and improve system performance. However, even with all of the benefits provided by the use of such integrated connectors, some of the methods traditionally used by systems designers to control and reduce EMI emissions no longer apply. Hence, designing for EMI compliance is, to some extent, shifting from the PCB and systems designers towards the integrated connectors' ability to effectively filter or suppress the EMI emissions, particularly at the high end of the EMI spectrum. Because of this, there are other EMI issues associated with the use of integrated RJ connectors that need to be addressed.

For example, since the magnetics are located inside the RJ connector, the system's PCB layout will be entirely different. Separate islands of digital, analog and chassis ground planes may not be available to implement the EMI suppression techniques previously discussed. Hence, a system utilizing integrated connectors sometimes experience aperture leakage. Simply stated, this means that there is, in effect, a "hole" in the EMI shielding at the unshielded area on the bottom of the connector (where the pins of the connector are located). This, coupled with what amounts to small "antennas" formed by the pins and the conductors within the integrated connector, can result in high frequency noise escaping from the equipment enclosure and either radiating into the environment or being coupled onto the transmission cable connected to the integrated RJ connector.

Trying to solve the aperture leakage problem on a system level is not practical due to the vast number of variables involved. This is because different systems will have different circuit designs, physical and electrical properties, PCB layout, etc.

Accordingly, there remains a need for an integrated RJ connector which provides both electromagnetic and electrostatic shielding while shunting very high frequency noise on the signal lines to ground to thereby alleviate aperture leakage problems.

SUMMARY OF THE INVENTION

The present invention is an RJ connector which incorporates a structure to eliminate aperture leakage at the bottom portion of the connector. The RJ connector in accordance with one aspect of the present invention includes a housing having a top portion and a bottom portion, and structured and arranged to receive a plug. A plurality of contact fingers are provided in the housing for making contact with corresponding contacts in the plug and corresponding signal pins provided at the bottom portion of the housing.

Arranged at the bottom portion of the housing is a shield. The shield includes at least one electrically isolated conductive element. The at least one electrically isolated conductive element is electrically connected to one of the signal pins and operates to suppress electromagnetic interference at the bottom portion of the housing. In particular, the electrically isolated conductive element forms a capacitor between the signal pin and a ground. To have the conductive element form the capacitor within the bottom shield, a grounding element is provided within the bottom shield. Preferably, the bottom shield is provided with a respective conductive element for each signal pin which is to be provided with a capacitance for the suppression of electromagnetic interference. In other words, a capacitance can be provided from one to all of the signal pins.

By carefully controlling the area, shape, and/or thickness of the conductive elements in the bottom shield, and their relative positions to one another, a certain amount of electrical capacitance will be present between each of the signal pins and ground. This capacitance acts to shunt any high frequency electronic noise present on the signal lines and effectively prevents EMI from exiting the bottom portion of the housing or otherwise being radiated or conducted onto the transmission lines of the plug.

Further, the housing may also be provided with a toroid assembly which contains the magnetics for suppressing EMI emissions from other portions of the housing.

The bottom shield is also preferably connected to a metal shield surrounding the rest of the housing by any number of mechanical or electrical means. When connected, the entire connector is covered by a conductive shield. This conductive shield can then be connected to chassis or earth ground so as to prevent EMI from entering or leaving the connector housing.

BRIEF DESCRIPTION OF THE DRAWINGS

Other features and advantages of the present invention will become apparent from the following description of the invention which refers to the accompanying drawings, wherein.

DETAILED DESCRIPTION OF EMBODIMENTS OF THE INVENTION

Figure 1A:
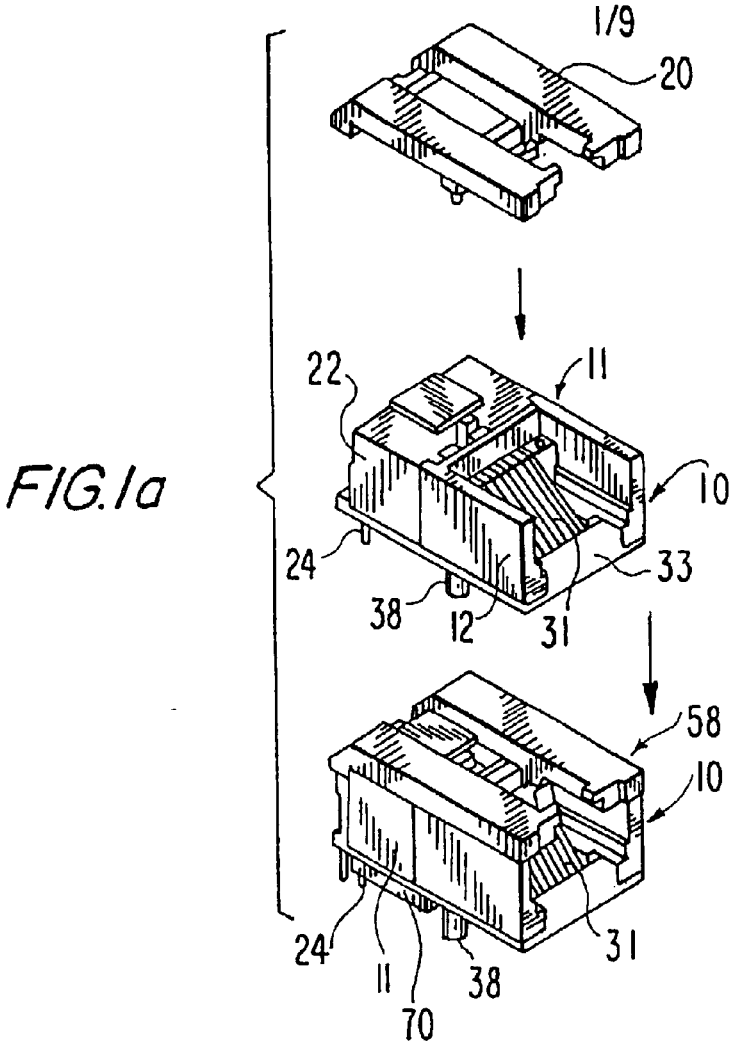
FIGS. 1*a*–1*c* are perspective exploded views showing the component parts of a single RJ connector in accordance with certain aspects of this invention, as well as the method of assembly of the component parts into the RJ connector.
Figure 1B:
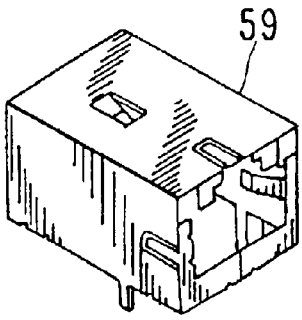
Figure 1C:
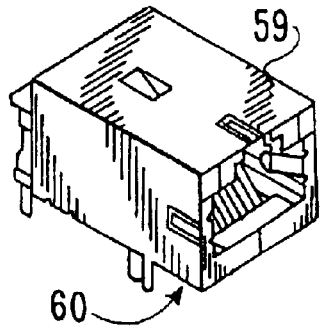

FIGS. 1*a* through 1*c* show a modular connector which includes a plastic housing 12 having a compartment for receiving RJ connector components. Such a connector is disclosed in Ser. No. 09/492,895, filed Jan. 27, 2000 and entitled "RJ Jack With Integrated Interface Magnetics", the entire disclosure of which is incorporated by reference herein.

Referring to the drawings and, in particular, to FIG. 1*a*, there is shown a contact pin block assembly 10 and a toroid base assembly 11 forming part of an RJ connector 58 of the present invention.

The contact pin assembly 10 includes a one-piece plastic housing 12 having side walls, a rear wall, a front wall having an interior chamber adapted to receive a modular plug (not shown) through an opening in the front wall, and a bottom wall.

The toroid base assembly 11 includes a plastic housing 22 which houses a plurality of magnetic toroid units functioning as filters or transformers which are connected by fine, multi-wrapped wires to a plurality of depending signal pins 24 (only one of which is shown) which extend downwardly from the toroid base assembly 11, the wires being dip soldered to the pins 24.

The contact pin assembly 10 has a plurality of conductive contact fingers 31, which project upwardly in the housing chamber at an angle towards the rear wall where they are received in respective slots (not shown). The contact fingers 31 extend downwardly over a front portion of the bottom wall and then extend along the underside of the bottom wall to the rear of the bottom wall.

The spacing between the contact fingers 31 within the housing chamber corresponds to the spacing of the contacts in the modular plug to be received in the chamber. On the bottom of the bottom wall, however, the spacing of the contact fingers 31 may be increased so as to reduce cross-talk and facilitate connection to a printed wiring board (not shown).

After assembly of the toroid base assembly 11 to the contact pin block assembly 10, the resultant unit is then mounted to a bottom plate 33. The plate 33 includes a plurality of openings (not shown) for receiving the depending signal pins 24 of the contact pin assembly. The bottom plate 33 also includes additional holes (not shown) for receiving mounting posts depending from the bottoms of the contact pin assembly 10 and the toroid base assembly 11 so as to facilitate alignment of the bottom plate 33 with the toroid base assembly 11 and the contact pin assembly 10. The bottom plate 33 also has a pair of depending mounting posts 38 (only one of which is shown) for mounting the resultant assembly to, for example, a printed wiring board (not shown).

Placed on the bottom plate 33 is a bottom shield 70. As shown in FIG. 2*a*, the bottom shield 70 preferably comprises a layered structure with the various layers performing various functions. The bottom shield 70 includes at least one electrically isolated conductive element. The at least one electrically isolated conductive element is electrically connected to one of the signal pins of the connector and operates to suppress electromagnetic interference at the bottom portion of the housing. In particular, the electrically isolated conductive element forms a capacitor between the signal pin and a ground.

With the embodiments described hereinafter, the bottom shield is described as having four (4) layers each of which is separated by an insulating layer 80. Also, in each of the embodiments of the bottom shield described herein, the same reference numerals are used to represent the layers of the bottom shield. Namely, the top layer is denoted by reference numeral 72, the second layer is denoted by reference numeral 74, the third layer is denoted by reference numeral 76 and the bottom layer is denoted by reference numeral 78.

Figure 2C:
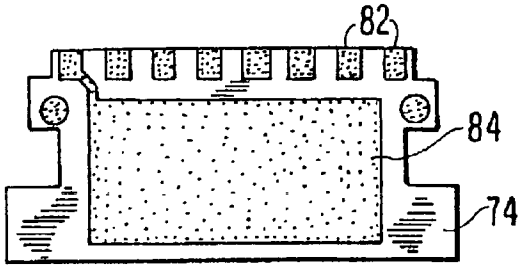
FIGS. 2*b*–2*e* show the component parts of a bottom shield in accordance with an embodiment of the invention.
Figure 2E:
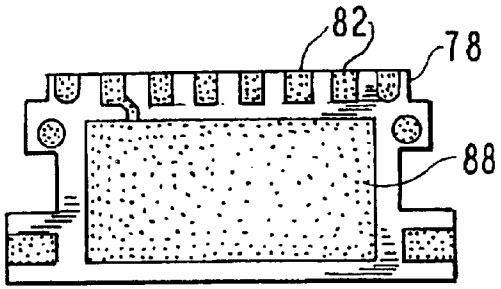
Figure 2A:
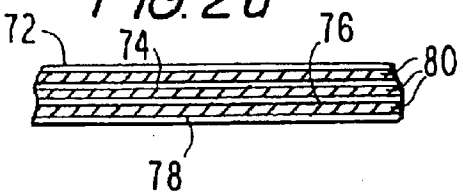
FIG. 2*a* is a cross sectional view of the bottom shield according to a preferred embodiment of the present invention.
Figure 2B:
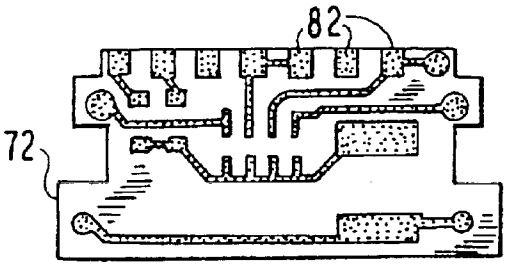

FIGS. 2*b* through 2*e* show one layout of the various layers of the bottom shield wherein capacitance is provided for a select few of the signal pins of the connector. FIG. 2*b* represents the top layer 72 and includes circuit wiring for the bottom shield 70. Provided in the top layer 72 are respective holes 82 for each of the signal pins 24 of the connector. FIG. 2*c* represents the second layer 74 of the bottom shield. This second layer includes a conductive pad 84 which, as can be seen in the upper left corner of the layer, is connected to the first hole 82. The signal pin can be connected to the conductive pad by solder or any number of other mechanical or electrical means.

Figure 2D:
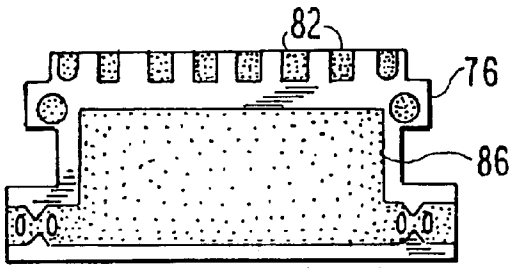

The third layer 76, shown in FIG. 2*d* is a ground layer. The third layer 76 includes a grounding element 86 which is connected to ground (i.e., either the chasis ground or earth ground). This grounding element 86 is electrically isolated from the conductive pad 84 in the second layer 74. When a signal is conducted through the signal pin connected to the conductive pad 84, a capacitor is formed within the bottom shield between the signal pin and ground. Accordingly, the ground layer operates as both a common ground for the shield and an EMI suppressor by providing a capacitance between the first signal pin and ground.

As further shown by FIG. 2*e*, a fourth layer 78 is provided. The fourth layer 78 includes a conductive pad 88 which, as can be seen in the upper left corner of the layer, is connected to a second one of the holes 82 for the signal pins of the connector. Similar to the second layer 74, the conductive pad 88 of the fourth layer 78 is also electrically isolated from the ground layer 76. Accordingly, when a signal is conducted through the signal pin connected to the conductive pad 88, a capacitor is formed within the bottom shield between the signal pin and ground. Therefore, this structure provides EMI suppression for both the first and second signal pins.

Preferably, the bottom shield is provided with a respective conductive element for each signal pin which is to be provided with a capacitance for the suppression of electromagnetic interference. In other words, a capacitance can be provided from one to all of the signal pins. Also, in order to maintain the proper capacitance, it is preferred that the conductive pads be of equal area. Other various embodiments for the bottom shield will now be described.

Figure 3B:
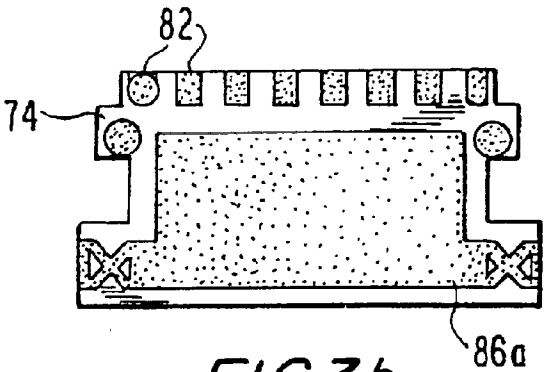
FIGS. 3*a*–3*d* show the component parts of a bottom shield in accordance with a further embodiment of the invention.
Figure 3D:
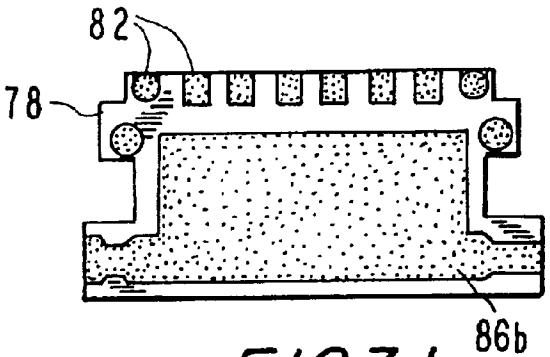
Figure 3A:
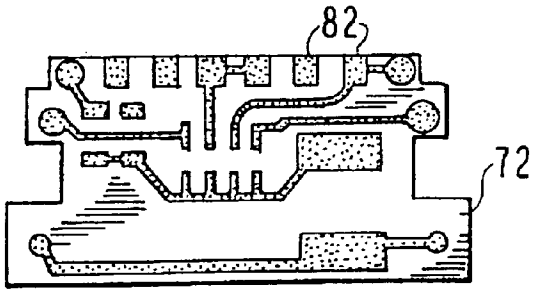

FIGS. 3*a* through 3*d* show another layout of the various layers of the bottom shield wherein capacitance is provided for a select few of the signal pins of the connector. In the embodiment shown in FIGS. 3*a* through 3*d*, there are two ground layers (i.e., the second and bottom layers), and a single conductive layer (the third layer) containing the conductive pads for the signal pins. FIG. 3*a* represents the top layer 72 and includes circuit wiring for the bottom shield 70. Provided in the top layer 72 are respective holes 82 for each of the signal pins 24 of the connector. FIG. 3*b* represents the second layer 74 of the bottom shield. The second layer 74 includes a first grounding element 86*a* which is connected to ground (i.e., either the chasis ground or earth ground).

Figure 3C:
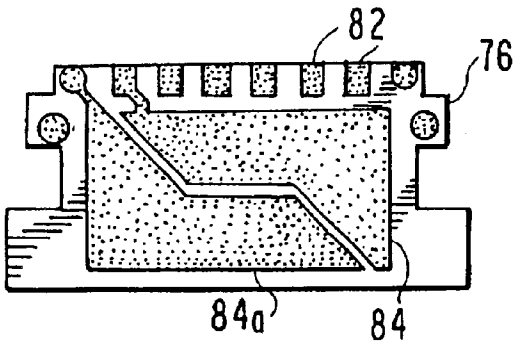

The third layer 76, shown in FIG. 3*c*, is the conductive layer. This third layer 76 includes a first conductive pad 84*a* which is connected to a first one of the holes 82 for the signal pins of the connector and a second conductive pad 84*b* which is connected to a second one of the holes 82 for the signal pins of the connector. Each of the first and second conductive pads 84*a*, 84*b* are of equal area and are electrically isolated from the grounding element 86*a*. Because of this electrical isolation, when a signal is conducted through the signal pin, the conductive pad and the ground form a capacitor between the signal pin and ground.

The fourth layer or bottom layer 78, shown in FIG. 3*d*, is a second ground layer. The fourth layer 78 includes a second grounding element 86*b* which is connected to ground (i.e., either the chasis ground or earth ground). This second grounding element 86*b* is electrically isolated from the conductive pads 84*a* and 84*b* in the third layer 76 and is kept at the same potential as that of the first grounding element 86*a*. This second grounding element 86*b* operates to shield the capacitor formed by the conductive pads 84*a* and 84*b* and the first ground layer from EMI. Accordingly, the structure shown in FIGS. 3*a* through 3*b* provides EMI suppression for both the first and second signal pins and the capacitors formed for these pins.

Figure 4A:
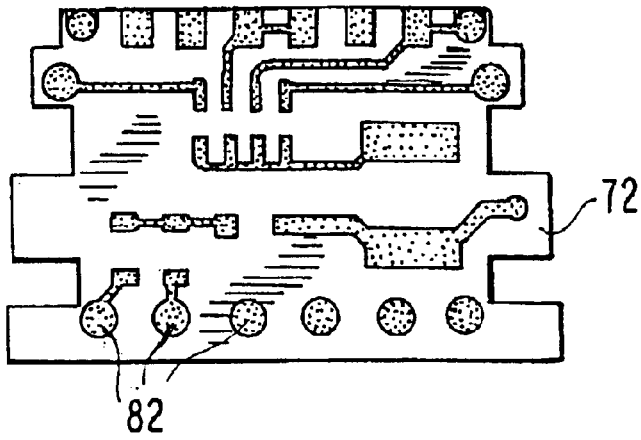
FIGS. 4*a*–4*d* show the component parts of a bottom shield in accordance with another embodiment of the invention.

FIGS. 4*a* through 4*d* show another layout of the various layers of the bottom shield wherein capacitance is provided for all of the signal pins of the connector. In the embodiment shown in FIGS. 4*a* through 4*d*, there are six holes provided in the top layer 72. This is because the connector for use with this embodiment has two sets of shorted contact fingers, thereby requiring only six signal pins leading from the housing. Accordingly, FIG. 4*a* represents the top layer 72 and includes circuit wiring for the bottom shield 70 and respective holes 82 for each of the signal pins 24 of the connector.

Figure 4B:
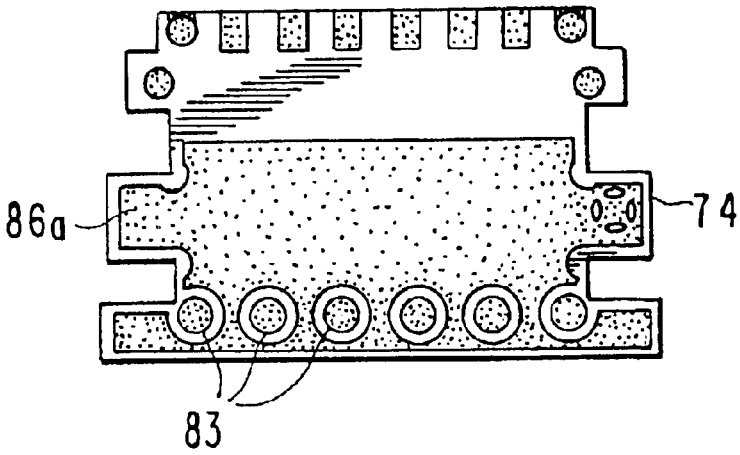

FIG. 4*b* represents the second layer 74 of the bottom shield. The second layer 74 includes the first grounding element 86*a* which is connected to ground (i.e., either the chasis ground or earth ground). As can be seen in FIG. 4*b*, there are through-holes 83 for each of the respective signal pins. These through-holes 83 are designed such that the signal pins can pass through the second layer 74 and not contact the grounding element 86*a*, i.e., the pins remain electrically isolated.

Figure 4C:
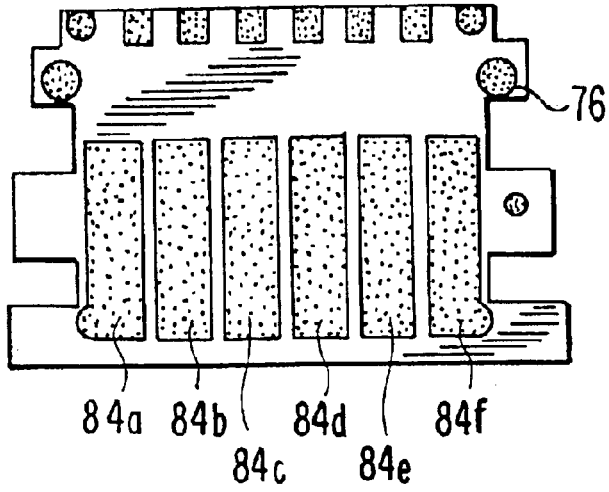

The third layer 76, shown in FIG. 4*c*, is the conductive layer. This third layer 76 includes six conductive pads 84*a* through 84*f*. Each of the conductive pads are connected to a respective one of the signal pins of the connector. Although not shown in the drawings, there is a through-hole in each of the conductive pads which allows the signal pin to pass through the conductive pad (and the entire bottom shield) and be coupled to the conductive pad by plating the through-hole. Each of the six conductive pads are of equal area and are electrically isolated from the grounding element 86*a*. Because of this electrical isolation, when a signal is conducted through the signal pin, the respective conductive pad and the ground form a capacitor between the signal pin and ground. The conductive pads are preferably of equal area so as to maintain the capacitance.

Figure 4D:
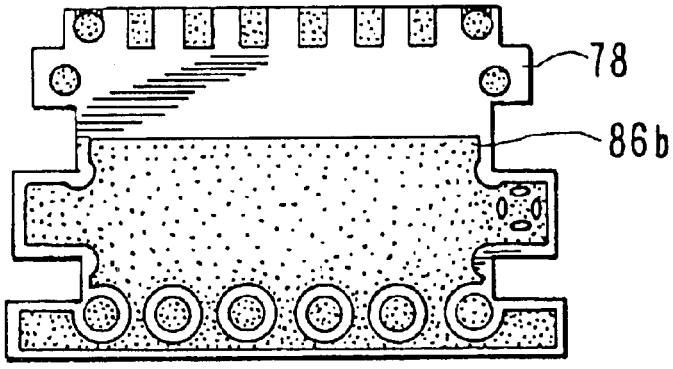

The fourth layer or bottom layer 78, shown in FIG. 4*d*, is a second ground layer and includes a second grounding element 86*b* which operates to shield the capacitor formed by each of the six conductive pads and the first ground layer from EMI, similar to that described above with reference to FIG. 3*d*.

Preferably, a metal shield 59 having an open bottom (FIG. 1*b*) is then placed around the RJ connector 58 resulting in the shielded RJ connector 60 shown in FIG. 1*c*. The bottom shield 70 is also preferably connected to the metal shield 59 surrounding the rest of the housing by any number of mechanical or electrical means. In particular, the one or more grounding layers described above are connected to the metal shield 59. When connected, the entire RJ connector is covered by a conductive shield. This conductive shield can then be connected to chassis or earth ground so as to prevent EMI from entering or leaving the connector housing.

Referring to FIG. 1*a*, the RJ connector has a top wall 20 which is inserted over the assembled contact pin block assembly 10 and toroid base assembly 11. The top wall 20 functions as a stopper and locking mechanism for the plug (not shown) which is received in the interior chamber of the housing. Preferably, the top wall 20 is made from a transparent plastic material. With this transparent top wall 20, LEDs can be mounted at the rear of the connector, and the transparent top wall 20 provides a means for coupling light from the LEDs to the front panel of the connector. Although FIG. 1*a* shows this arrangement with a single RJ connector, it can also be adapted for use with the multiport connector described below.

Figure 5B:
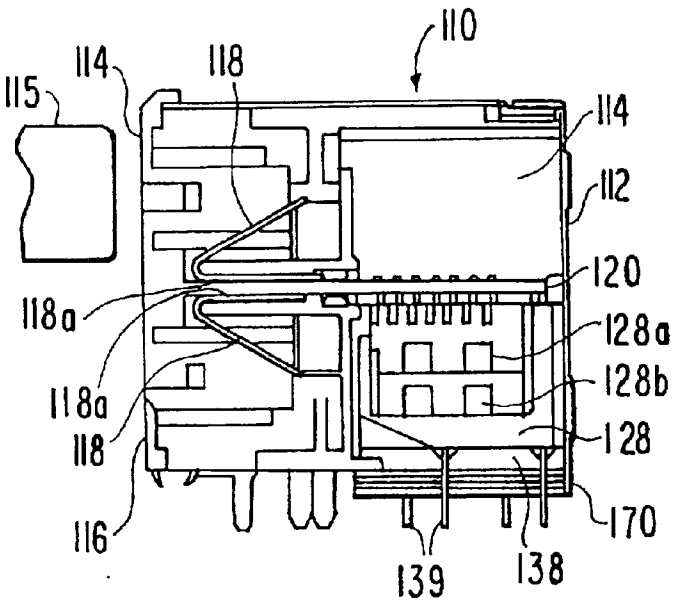
FIG. 5*b* is a side view of the multiport connector of FIG. 5*a;*
Figure 5A:
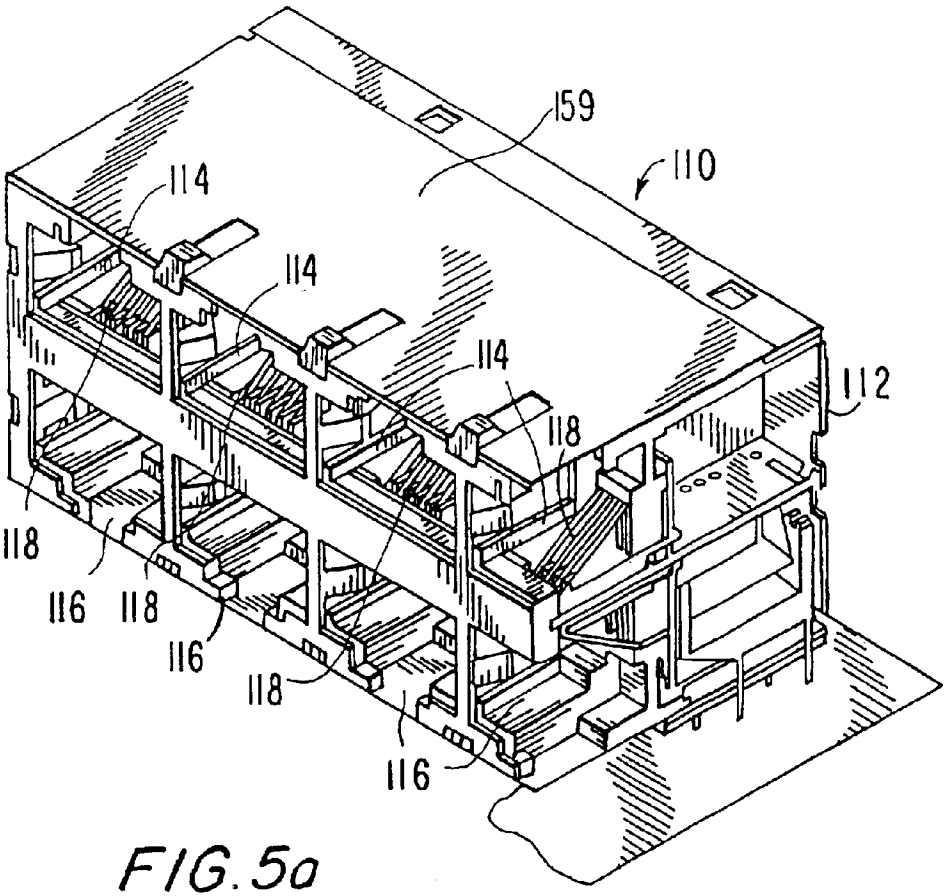
FIG. 5*a* is a perspective view showing the component parts of a multiport RJ connector in accordance with certain aspects of this invention.

FIGS. 5*a* and 5*b* show a multiport connector 100 in a stacked configuration which includes a plastic housing 112 having multiple compartments for receiving RJ connector components. This connector housing 112 is similar to that described above with reference to FIGS. 1*a* through 1*c*.

More specifically, the compartments, which function as individual RJ connectors, are arranged in vertically aligned pairs of upper and lower compartments 114 and 116, respectively, with each compartment being shaped and dimensioned to receive a conventional modular RJ plug 115 (only one of which is diagrammatically shown in FIG. 5*b*). Each compartment 114, 116 includes a plurality of resilient conductive contact fingers 118 which project upwardly at an angle towards the rear wall of the compartment for receiving and making contact with the modular plugs.

Opposing portions 118*a* of the fingers 118 make contact with a multilayer printed wiring board 120 having circuit patterns on opposed external surfaces of non-conductive layers which sandwich an internal metal shielding layer. The shielding layer serves to electrically shield the components in the upper and lower compartments 114 and 116 from each other.

One of the compartments, in this case the lower compartment 116, includes a toroid base unit 128, which houses two sets of magnetic toroid units 128*a* and 128*b* (FIG. 5*b*) functioning as filters or transformers, one set for the upper compartment 114 and one set for the lower compartment 116. The toroid base unit 128 is then assembled to a bottom plate 138. The plate 138 includes a plurality of openings for receiving depending conductive pins 139 depending from the bottom of the toroid base assembly 128. The top ends of pins 139 are electrically connected to the toroid units and the bottom ends are connected to an external circuit (not shown).

Placed on the bottom plate 138 is a bottom shield 170. Bottom shield 170 is similar to the bottom shield described above with reference to FIG. 2*a*. Preferably, the bottom shield 170 comprises a layered structure with the various layers performing various functions.

With the embodiments described hereinafter, the bottom shield is described with reference to the cross-section of FIG. 2*a* as having four (4) layers each of which is separated by an insulating layer 80. Although the bottom shield is described as having four layers, it will be readily apparent given the detailed disclosure herein that an infinite number of layers can be used, and the number of which will depend upon the particular design of the bottom shield and the connector. Also, in each of the embodiments of the bottom shield described below, the same reference numerals are used to represent the layers of the bottom shield as those used previously herein. Namely, the top layer is denoted by reference numeral 72, the second layer is denoted by reference numeral 74, the third layer is denoted by reference numeral 76 and the bottom layer is denoted by reference numeral 78.

Figure 6A:
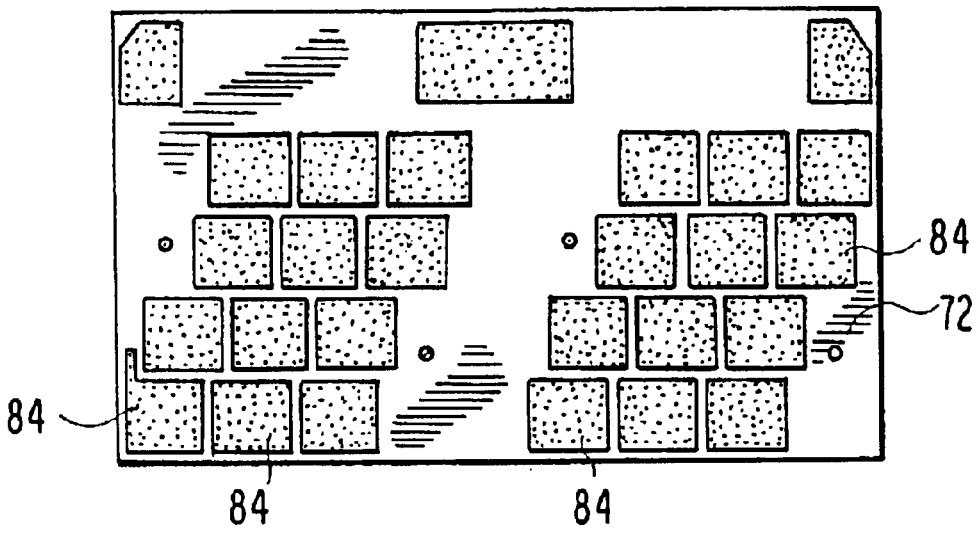
FIGS. 6*a*–6*d* show the component parts of a bottom shield for a multiport connector in accordance with an embodiment of the invention.

FIGS. 6*a* through 6*d* show one layout of the various layers of the bottom shield for a multiport connector wherein capacitance is provided for all of the signal pins of the connector. FIG. 6*a* represents the top layer 72 and includes a conductive pad 84 for each signal pin. Although not shown in the drawings, there is a through-hole in each of the conductive pads 84 which allows the signal pin to pass through the conductive pad (and the entire bottom shield) and be coupled to the conductive pad by plating the through-hole. Each of the conductive pads in FIG. 6*a* are preferably of equal area so as to maintain the capacitance.

Figure 6B:
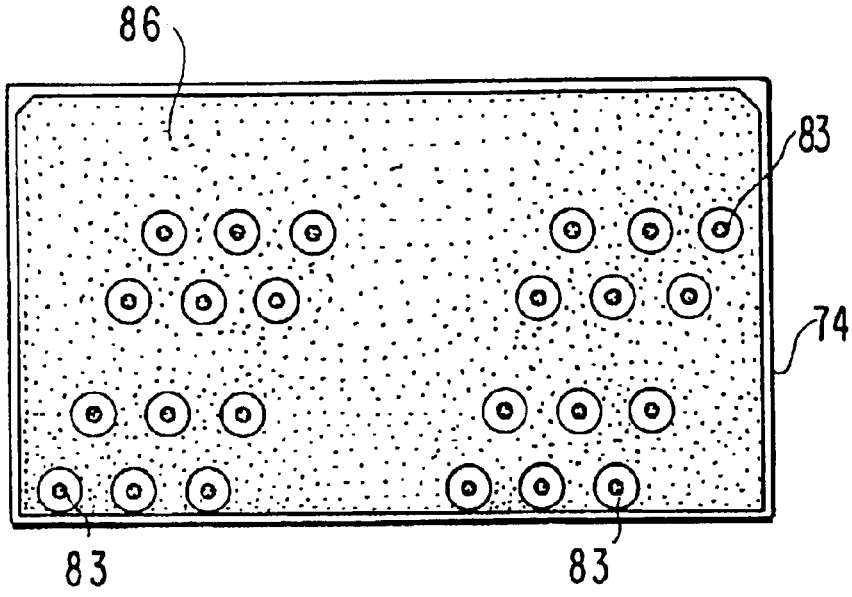

FIG. 6*b* represents the second layer 74 of the bottom shield. The second layer 74 includes a grounding element 86 which is connected to ground (i.e., either the chasis ground or earth ground). As can be seen in FIG. 6*b*, there are through-holes 83 for each of the respective signal pins. These through-holes 83 are designed such that the signal pins can pass through the second layer 74 and not contact the grounding element 86, i.e., the pins remain electrically isolated.

Figure 6C:
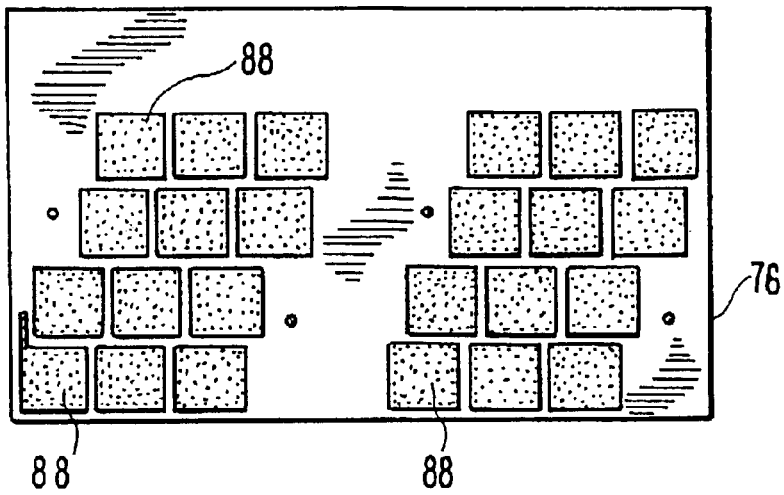

FIG. 6*c* represents the third layer 76 of the bottom shield for the multiport connector. The third layer 76 includes a second conductive pad 88 for each of the signal pins of the connector. Similar to the first layer 72, the conductive pads 88 of the third layer 77 are also electrically isolated from the ground layer 74 by providing a through-hole (not shown) in each of the conductive pads 88 which allows the signal pin to pass through the conductive pad (and the entire bottom shield) and be coupled to the conductive pad by plating the through-hole. Also, each of the conductive pads in FIG. 6*c* are preferably of equal area so as to maintain the capacitance.

Figure 6D:
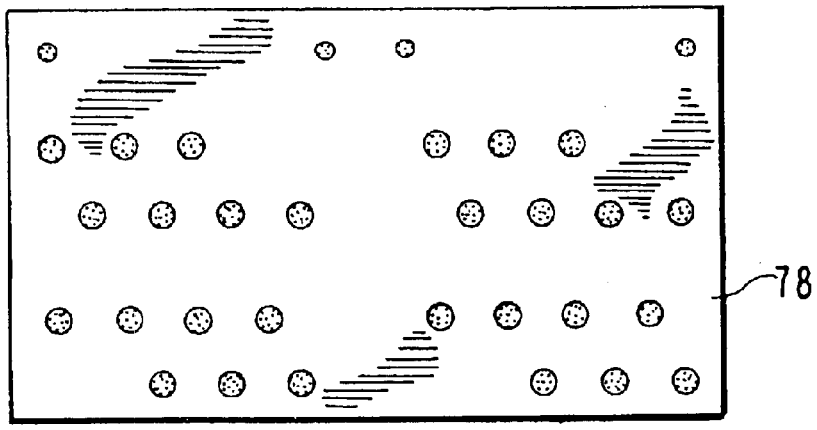

The fourth layer or bottom layer 78, shown in FIG. 6*d*, is the layer which facilitates plating the through-holes. The operation of the layers in FIGS. 6*a* through 6*d* is similar to that described above in that, when a signal is conducted along the signal pins, the conductive pads and the grounding element operate to form a capacitor between the signal pin and ground.

Figures 7A, 7B, 7C, 7D:
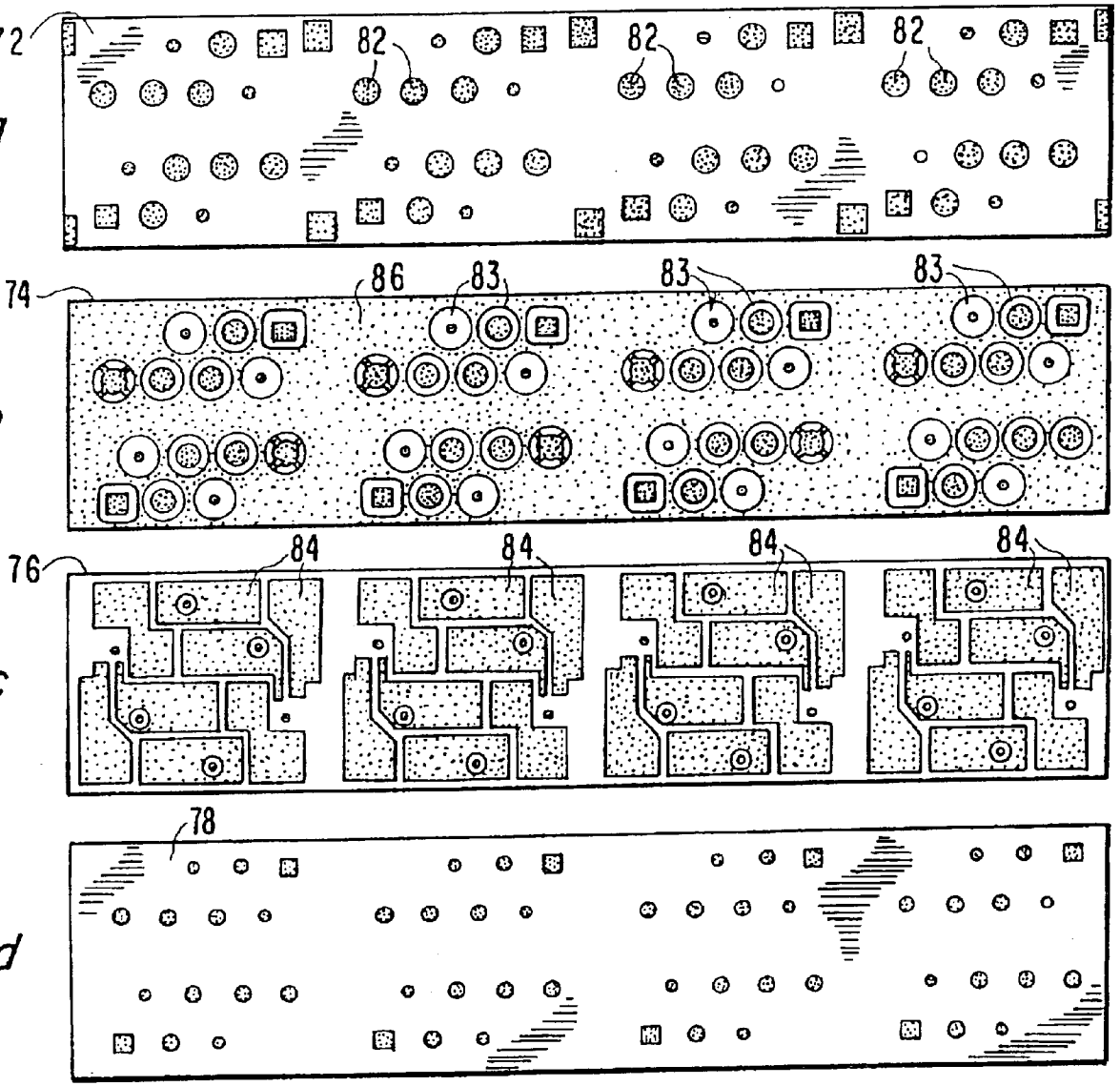
FIGS. 7*a*–7*d* show the component parts of a bottom shield for a multiport connector in accordance with a further embodiment of the invention.

FIGS. 7*a* through 7*d* show another layout of the bottom shield 170 for a multiport connector where capacitance is provided for all of the signal pins of the connector. FIG. 7*a* represents the top layer 72 and includes through-holes 82 for placement of respective signal pins from the connector housing.

FIG. 7*b* represents the second layer 74 of the bottom shield. The second layer 74 includes the grounding element 86 which is connected to ground (i.e., either the chasis ground or earth ground). As can be seen in FIG. 7*b*, there are through-holes 83 for each of the respective signal pins. These through-holes 83 are designed such that the signal pins can pass through the second layer 74 and not contact the grounding element 86, i.e., the pins remain electrically isolated through this layer.

The third layer 76, shown in FIG. 7*c*, is the conductive layer. This third layer 76 includes separate conductive pads 84 for each of the signal pins. Each of the conductive pads 84 are connected to a respective one of the signal pins of the connector. Although not shown in the drawings, there is a through-hole in each of the conductive pads which allows the signal pin to pass through the conductive pad (and the entire bottom shield) and be coupled to the conductive pad by plating in the through-hole. Each of the six conductive pads are of equal area and are electrically isolated from the grounding element 86. Because of this electrical isolation, when a signal is conducted through the signal pin, the respective conductive pad and the grounding element form a capacitor between the signal pin and ground. As shown, the conductive pads are of equal area so as to maintain the capacitance. The fourth layer or bottom layer 78, shown in FIG. 6*d*, is the layer for plating the through-holes.

Preferably, and as shown in FIG. 5*a*, a metal shield 159 having an open bottom is then placed around the multiport RJ connector. The bottom shield 170 is also preferably connected to the metal shield 159 surrounding the rest of the housing by any number of mechanical or electrical means. In particular, the one or more grounding layers described above are connected to the metal shield 159. When connected, the entire multiport RJ connector is covered by a conductive shield. This conductive shield can then be connected to chassis or earth ground so as to prevent EMI from entering or leaving the connector housing.

In alternate embodiments, the bottom shield can provided in addition to the bottom plate, or the bottom shield can be formed as the bottom plate of the connector housing.

By carefully controlling the area, shape, and/or thickness of the conducting and insulating materials within the bottom shield, and their relative positions to one another, a certain amount of electrical capacitance will be present between each of the signal pins and ground. This inherent capacitance acts to shunt any high frequency electronic noise present on the signal lines. This also acts to prevent EMI from exiting the system enclosure or otherwise being radiated or conducted onto the transmission line connected to the connector.

There are many different ways of configuring and fabricating the bottom shield of the present invention. These include PCB's, laminated structures, a non-laminated structures, molded structures and thin or thick film hybrids, to name a few. Examples of such structures are described below. More advanced methods, utilizing techniques that are tailored to a given process or technology, are possible, though the basic principle is the same.

The preferred structure of the bottom shield of the connector housing is to use an inexpensive printed circuit board, such as copper clad reinforced fiberglass (FR-4). The advantages to the use of a PCB include that it can be designed to have the desired layers, patterns, shape, interconnects, and mechanical properties needed to form the capacitive elements which function as electronic filters. Further, the PCB can provide secondary mechanical functions including, but not limited to, pin fastening, spacing and alignment; PCB mounting mechanisms; and the formation of slots or cut-outs for securing other parts of the connector.

This method is advantageous because PCB fabrication is a mature, proven, and well-controlled technology, is relatively inexpensive, and is readily available worldwide.

Any laminated structure that can replicate the fundamental principles of the PCB method described above can also be used. Such laminated structures could, for example, be a lamination of conductive and insulating materials formed from any number of types of metals, plastics/polymers, ceramics and/or phenolic compounds. For example, a lamination comprising thin sheets of copper and plastic could be used. The sheets can be pre-stamped, etched, or otherwise cut into the desired geometry before the lamination process, or be processed after lamination in any number of ways.

These laminated structures may be more advantageous than their PCB equivalent in that there are a wide variety of materials available that can be tailored to achieve the desired performance characteristics. The materials can be chosen based on their physical and electrical properties, cost, and ease of manufacturing such that an optimum structure is obtained. Additionally, secondary functions such as alignment posts, PCB mounting apparatus, raised or indented company logo, part number, patent numbers or other alphanumerical markings could be easily incorporated on the outer layers of the lamination.

Alternatively, the bottom shield may take the form of individual pieces that are simply assembled together to form a multi-layered structure. For example, the conductive elements of the structure can simply be an extension of the connector pins, such as in the form of a lead frame. Also, inexpensive sheet metal, copper or tin foil or even applied conductive coatings could be used as the conductive elements. The insulating or dielectric portions of the bottom shield may be made from any number of plastic materials, common insulating tape, sprayed-on lacquers, varnish or paint, waxed paper, or even air. In essence, any conceivable method of creating a structure (normally as part of the connector housing) that can act as both a shield and form capacitor-like elements can be used to achieve the desired EMI suppression properties. Similar to the laminated structures, secondary functions can be incorporated on the outer layers of the structure.

The bottom shield of the present invention can also be formed from molded structures. For example, pre-formed conductive elements can be embedded within an insulating material using standard injection molding processes. With this technique, the molding compound is easily used as the dielectric (insulating) material. The main advantage of a molded structure is a low manufacturing and assembly cost.

Advanced methods of creating the bottom shield might include, but are not limited to, thin or thick film hybrids on any appropriate base substrate material such as alumina, ceramic, beryllium oxide, FR4 fiberglass, flexible PCB's, sheet metal, copper, etc. Metal deposition technology such as sputtering, electroplating, or chemical etching may also be used to form the various substructures or to increase the surface area of the conductive elements within the structure.

Some of the advantages and features of the above-described RJ connector are as follows.

The bottom shield acts as an electrostatic/electromagnetic shield which forms capacitive elements that function as electronic filters.

Further, the bottom shield provides secondary mechanical functions including, but not limited to, pin fastening, spacing and alignment, and PCB mounting characteristics.

Moreover, the bottom shield can be provided with slots or cut-outs to facilitate the securing of other component parts of the connector.

As is evident from the foregoing detailed description, the teachings of the present invention are not limited to solely to RJ connector applications. The above-described connector structure can be applied to any type of electronic component packaging or circuit where it is desirable to have an EMI suppression function. Such applications include any type of modular components or devices, such as molded magnetics/filter modules; encapsulated circuits, such as DC—DC converter modules, power semiconductor switching modules, amplifier or attenuator modules; and modular switches or relays, to name a few.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A modular connector, which comprises:

a housing having at least two aligned compartments, a top portion and a bottom portion, each compartment being structured and arranged to receive respective plugs;

a plurality of signal pins provided at the bottom portion of the housing;

a shield arranged at the bottom portion of the housing, the shield having a first electrically isolated conductive element electrically connected to one signal pin of the plurality of signal pins, the first conductive element being operable to suppress electromagnetic interference at the bottom portion of the housing; and a multilayer printed wiring board separating the two compartments.

2. The modular connector according to claim 1, further comprising:

a first plurality of conductive contact fingers in one of the compartments, each of the fingers of the first plurality of fingers having a first portion for making electrical contact with one of the plugs and a second portion for making electrical contact with one of the plurality of signal pins; and a second plurality of conductive contact fingers in the other of the compartments, each of the fingers of the second plurality of fingers having a first portion for making electrical contact with the other one of the plugs and a second portion for making electrical contact with a second portion of the plurality of signal pins.

3. The modular connector according to claim 1, wherein the shield includes a plurality of separate electrically isolated conductive elements for each of the plurality of signal pins, each of the separate conductive elements being electrically connected to a respective one of the plurality of signal pins.

4. The modular connector according to claim 1, wherein one of the compartments has a toroid assembly housing for housing two sets of toroids, one set for one compartment and the other set for the other compartment.

5. The modular connector according to claim 1, wherein the conductive element forms a capacitor between the one signal pin and a ground.

6. The modular connector according to claim 5, wherein the first conductive element is electrically isolated by an insulating material.

7. The modular connector according to claim 1, wherein the shield is a layered structure.

8. The modular connector according to claim 7, wherein the layered structure comprises:

a first conductive layer having the first conductive element; and a ground layer electrically isolated from the first conductive layer, the ground layer being corrected to a ground and arranged so as to form a capacitor with the first conductive element.

9. The modular connector according to claim 8, wherein the ground layer is electrically isolated from the first conductive layer by an insulating layer.

10. The modular connector according to claim 8, further comprising a second conductive layer electrically isolated from the ground layer and the first conductive layer, the second conductive layer including a second conductive element electrically connected to the one signal pin, the first and the second electrically conductive elements forming a capacitor between the one signal pin and the ground layer.

11. The modular connector according to claim 1, wherein the housing includes a left side portion and a right side portion, and the connector further comprises a metal casing covering the top portion, the right side portion and the left side portion.

12. The modular connector according to claim 11, wherein the metal casing is connected to a ground.

13. The modular connector according to claim 12, wherein the shield is grounded to the metal casing.

* * * * *